US007610152B2

(12) United States Patent
Meyer

(10) Patent No.: US 7,610,152 B2
(45) Date of Patent: Oct. 27, 2009

(54) TRAIN NAVIGATOR WITH INTEGRAL CONSTRAINED GPS SOLUTION AND TRACK DATABASE COMPENSATION

(75) Inventor: Thomas J. Meyer, Corfu, NY (US)

(73) Assignee: Lockheed Martin Corp., Bethesda, MD (US)

( * ) Notice: Subject to any disclaimer, the term of this patent is extended or adjusted under 35 U.S.C. 154(b) by 0 days.

(21) Appl. No.: 11/416,069

(22) Filed: May 3, 2006

(65) Prior Publication Data

US 2006/0271291 A1 Nov. 30, 2006

Related U.S. Application Data

(60) Provisional application No. 60/677,333, filed on May 4, 2005.

(51) Int. Cl.
*G01C 21/00* (2006.01)

(52) U.S. Cl. ..... 701/213; 700/29; 700/33; 700/55; 700/78

(58) Field of Classification Search ..... 246/122 R; 701/213; 700/29, 30, 33, 34, 55, 78; *G01C 21/00*
See application file for complete search history.

(56) References Cited

U.S. PATENT DOCUMENTS 5,789,671 A * 8/1998 Fernandez ..... 73/180
5,912,643 A * 6/1999 Chew et al. ..... 342/457
5,941,935 A * 8/1999 Fernandez ..... 701/220
5,977,909 A * 11/1999 Harrison et al. ..... 342/357.09
6,064,916 A * 5/2000 Yoon ..... 700/44
6,218,961 B1 * 4/2001 Gross et al. ..... 340/903
6,246,960 B1 * 6/2001 Lin ..... 701/214
6,459,990 B1 * 10/2002 McCall et al. ..... 701/220
6,853,866 B2 * 2/2005 Heching et al. ..... 700/33
7,050,883 B2 * 5/2006 Cho et al. ..... 700/188
7,113,835 B2 * 9/2006 Boyden et al. ..... 700/52
7,194,318 B2 * 3/2007 Attarwala ..... 700/29
2001/0020216 A1 * 9/2001 Lin ..... 701/216
2002/0111717 A1 * 8/2002 Scherzinger et al. ..... 701/1
2003/0125818 A1 * 7/2003 Johnson ..... 700/28
2003/0163332 A1 * 8/2003 Podgurny et al. ..... 705/1
2005/0240347 A1 * 10/2005 Yang ..... 701/220

* cited by examiner

*Primary Examiner*—Tuan C To
(74) *Attorney, Agent, or Firm*—Wallace G. Walter

(57) ABSTRACT

The present invention provides a new set of algorithmic solutions to accommodate track inaccuracy information in track databases. Navigation and measurement aiding processes are defined by a stochastic mode relative to a moving rail frame defined so that it is aligned with the heading of the compensated track database at the current along track-position. Filtering generates long and short wavelength track alignment disturbances commensurate with track grade to compensate for track database errors; a stochastic error model is defined as the difference between the deterministic implementation and the actual stochastic processes Bayesian estimation of the error variables is implemented via a digital Kalman filter with the navigation, database, and measurement errors removed by subtracting the filter estimates.

6 Claims, 5 Drawing Sheets

TRAIN NAVIGATOR WITH INTEGRAL CONSTRAINED GPS SOLUTION AND TRACK DATABASE COMPENSATION

CROSS-REFERENCE TO RELATED APPLICATION

This patent application claims the benefit of commonly owned U.S. Provisional Patent Application 60/677,333 filed May 4, 2005 by the inventor herein and entitled "A Train Navigator with Integral Constrained GPS Solution and Track Database Compensation."

BACKGROUND OF THE INVENTION

The present invention relates to train/locomotive location systems and, more particularly, to train location systems for continuously and accurately identifying the location of a train on or within a trackway system using a train-mounted navigator geo-positional receiver solution in combination with track database information. Various systems have been developed to track the movement of and location of railway locomotives/trains on track systems including the system disclosed in U.S. Pat. No. 6,641,090 to Thomas J. Meyer and the system disclosed in commonly assigned U.S. patent application Ser. No. 10/980,191 filed Nov. 4, 2004 by Thomas J. Meyer (the respective disclosures of which is incorporated herein by reference); in these location determination systems inertially sensed orthogonal acceleration inputs and turn-rate information and GPS/DGPS information are combined with other inputs, such as those provided by one or more wheel-mounted tachometers, to provide information related to velocity and location.

Typically, track databases are maintained that store track information including the absolute and relative position of tracks and track transitions such as, for example, switches, turnouts and crossovers. Ideally, railroad tracks are perfectly uniform and remain consistent with their original design as straight sections connected by constant curve and spiral sections. In practice, however, weather and geographical conditions, train speeds, tonnage, and continued maintenance requirements contribute to railroad track non-uniformities. The Federal Track Safety Standards (FTSS) divides railroad track into nine (9) speed-related classifications as a function of speed (49 C.F.R. 213) with permissible variations of track geometry provided for each track class as shown, for example, in the following table for tangent track classes 1-5:

| Class of Track | Tangent Track The deviation of the mid-chord off-set from a 62 ft line may not be more than (inches) |
|---|---|
| Class 1 Track | 5 |
| Class 2 Track | 3 |
| Class 3 Track | 1¾ |
| Class 4 Track | 1½ |
| Class 5 Track | ¾ |

In the table above and as shown in FIG. 1, the alignment deviation (viz., side-to-side or lateral deviation) for straight tangent tracks is defined as the mid-offset deviation from a 62 foot chord line. As shown in the table above, the deviation varies from a maximum of 5 inches for a class 1 track to 0.75 inches for a class 5 track with analogous dimensional limits specified for curved track. In addition to the alignment deviations shown in FIG. 1, standards also exist for profile deviations (i.e., change along the up/down axis for a chord of a selected length). Although the FRA (Federal Rail Administration) regulates the amount of track irregularities permitted for each track class (Class 1-9), most track database information carries errors that can change with time and which are often difficult to and expensive to ascertain with accuracy.

Track databases can be created from the original design specification for the straight tangent sections, the curved sections, and the spiral track sections, although inconsistencies can exist between the tracks as designed and the tracks as initially built, and the tracks after years of use. Track databases can also be created from physical surveys of the tracks, although highly accurate surveys are considered costly.

Additionally, databases can be assembled from information based upon the track as surveyed and the track as designed using data "fitting" techniques intended to increase the probability that the so-assembled database will more closely approximate the actual track.

As shown in FIG. 2, side-to-side alignment deviations can affect heading inputs and path length inputs. In FIG. 2, points A and B represent endpoints through which the physical track (dotted-line) passes; in the as-designed database, the path length between points A and B is shown as a straight solid line. For a locomotive traveling from the left at a constant velocity and passing though point A toward point B, expected heading inputs and acceleration inputs should be relatively constant. As shown by the non-straight physical track path (dotted-line) caused by track deviations, the actual heading inputs will vary about the nominal database heading, any acceleration inputs expected between the A-B points will varying as a consequence of the side-to-side deviations, and the actual path length between points A and B will be greater than the database value because of the side-to-side deviations. The more general case is shown in FIG. 3, in which actual track path (dotted-line) continuously deviates from one side to the other with corresponding changes in heading; the measured inputs from the perspective of the locomotive will show substantial variation in heading, acceleration values, and distance traveled that will be different from the database model which will expect substantially less heading, acceleration, and distance traveled variation/values.

Accurate track databases are desired to reduce the probability of false wrong-track alarms, i.e., those situations in which the position information obtained from on-board navigation equipment of the type disclosed in the above-incorporated patent and patent application deviates from the database information sufficiently to raise a position-error alarm or a track-error alarm. In those cases where the accuracy of the a priori database is known to be poor, the fault detection system (s) are operated with 'loose' fault-tripping criteria to minimize the number of false alarms and minimize those fault alarms triggered by inaccurate data predicted by the database. As can be appreciated, a need exists to treat or condition measured navigation inputs in such a way to address the errors introduced by track class-constrained track irregularities in order to effect simultaneous navigation and track database compensation.

SUMMARY OF THE INVENTION

The present invention provides a set of algorithmic solutions to accommodate track inaccuracy information in track databases; navigation and measurement aiding processes are defined by a stochastic model relative to a moving rail frame defined so that it is aligned with the heading of the compensated track database at the current along track-position. A track alignment compensation model generates long and short wavelength track alignment disturbances commensurate with the track class to compensate for track database errors; a stochastic error model is defined as the difference between the deterministic implementation and the actual stochastic processes. Bayesian estimation of the error variables is implemented via a digital Kalman filter with the navigation, database, and measurement errors removed by subtracting the filter estimates.

The new solution processes GPS data on an individual (i.e. satellite-by-satellite) basis in the form of Doppler measurement, pseudorange measurement, and carrier phase data received from each satellite. Processing of each of these data is formulated to be commensurate with the fact that the device lies upon and is traveling upon a railway track with geometry prescribed by the compensated track database. Processing of individual satellite data enables position determination when operating in environments with clear line-of-sight to as few as just one satellite. Processing of individual satellite data also (under favorable conditions) allows a diverse solution to the route determination problem via self-differential GPS algorithm. This computation is diverse from the inertial navigation solution in the sense of both data diversity and algorithmic diversity.

The full scope of applicability of the present invention will become apparent from the detailed description to follow, taken in conjunction with the accompanying drawings, in which like parts are designated by like reference characters.

DESCRIPTION OF THE PREFERRED EMBODIMENT

Figure 1:
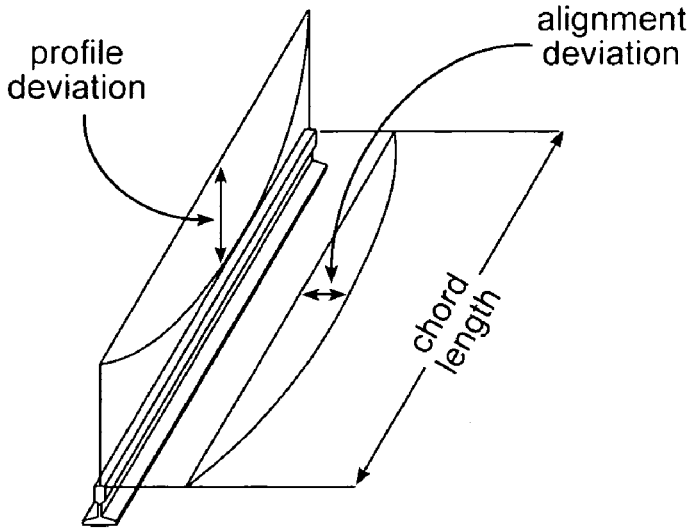
FIG. 1 is an isometric representation of a section of rail showing the manner by which alignment and profile deviation are measured.
Figure 2:
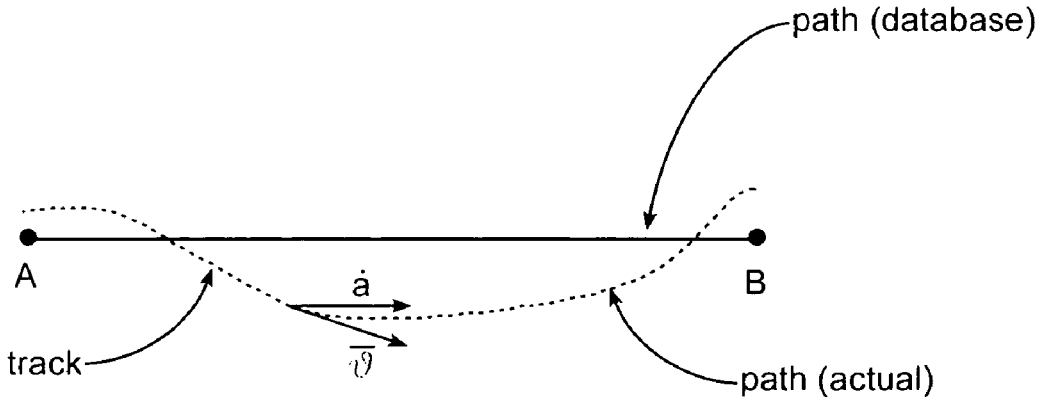
FIG. 2 is a schematic diagram illustrating the path difference between actual track (dotted-line illustration) and the database presentation (solid-line)
Figure 3:
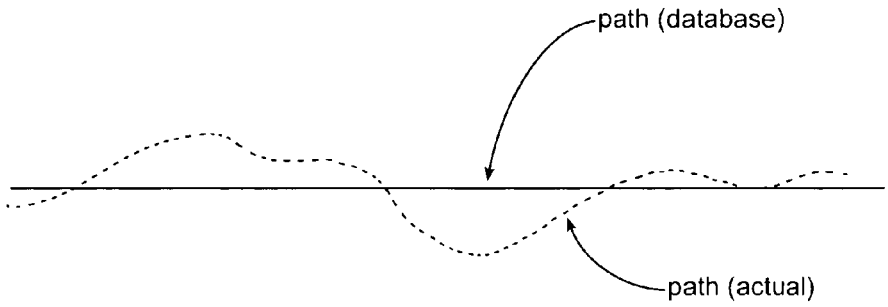
FIG. 3 is a further schematic diagram illustrating the path deviation between actual track (dotted-line illustration) and the database presentation (solid-line)
Figure 4:
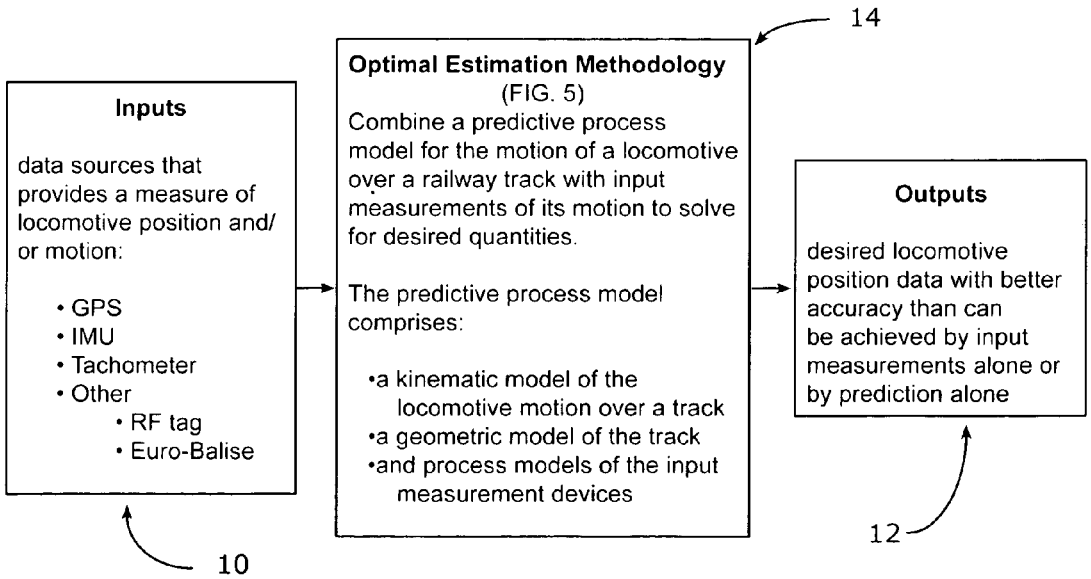
FIG. 4 is a overall input/output model of the methodology of the present invention.

As shown in the overall input/output block diagram of FIG. 4, the preferred embodiment accepts various data source inputs 10 of the type provided in the above incorporated U.S. Pat. No. 6,641,090 and U.S. patent application Ser. No. 10/980,191 filed Nov. 4, 2004 including GPS inputs, processing of individual satellite data, inertial measurement inputs (IMU), and wheel tachometer inputs, all of which are subject to the track deviation issues mentioned above in relationship to FIGS. 2 and 3. Additionally, inputs may include RF tag information and/or information from the Euro-Balise system, which places transponder devices at selected points along the trackway with information transmitted to and from those fixed-position devices when activated by the passing locomotive. As an output 12, the system provides the desired locomotive position with a higher degree of accuracy than can be provided by the input measurements alone or by prediction models alone.

As shown in block 14 of FIG. 4, the optimal estimation methodology of the preferred embodiment provides a predictive process model for the motion of a locomotive over a railway track with input measurements of its motion to solve for desired quantities in which the predictive process model (described below in relationship to FIGS. 5A and 5B) includes a kinematic model of the motion of the locomotive over the track and a geometric model of the track and process models of the input measurement devices.

Figure 5A:
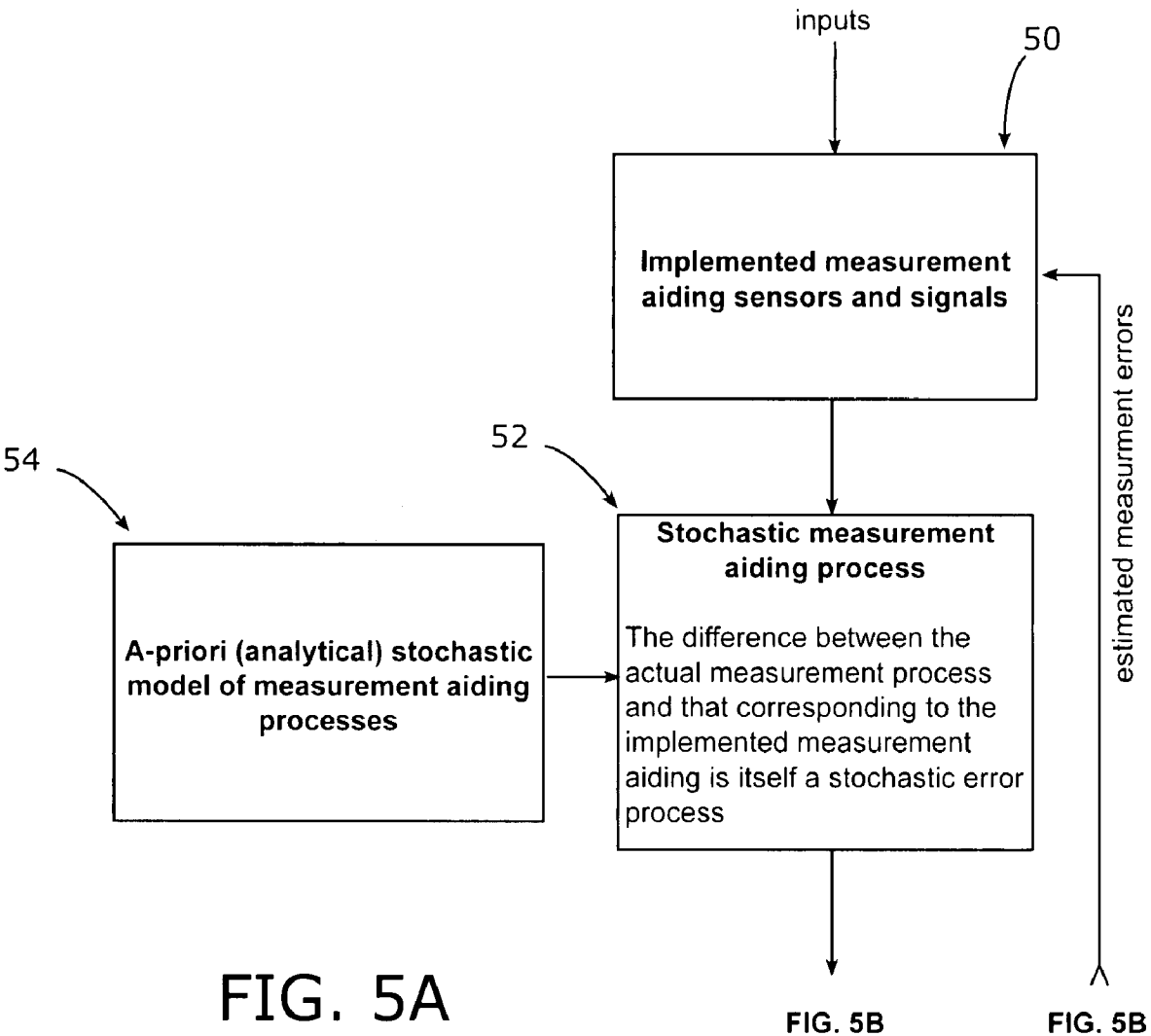
FIG. 5A is a first portion of schematic block diagram of the methodology of the present invention.
Figure 5B:
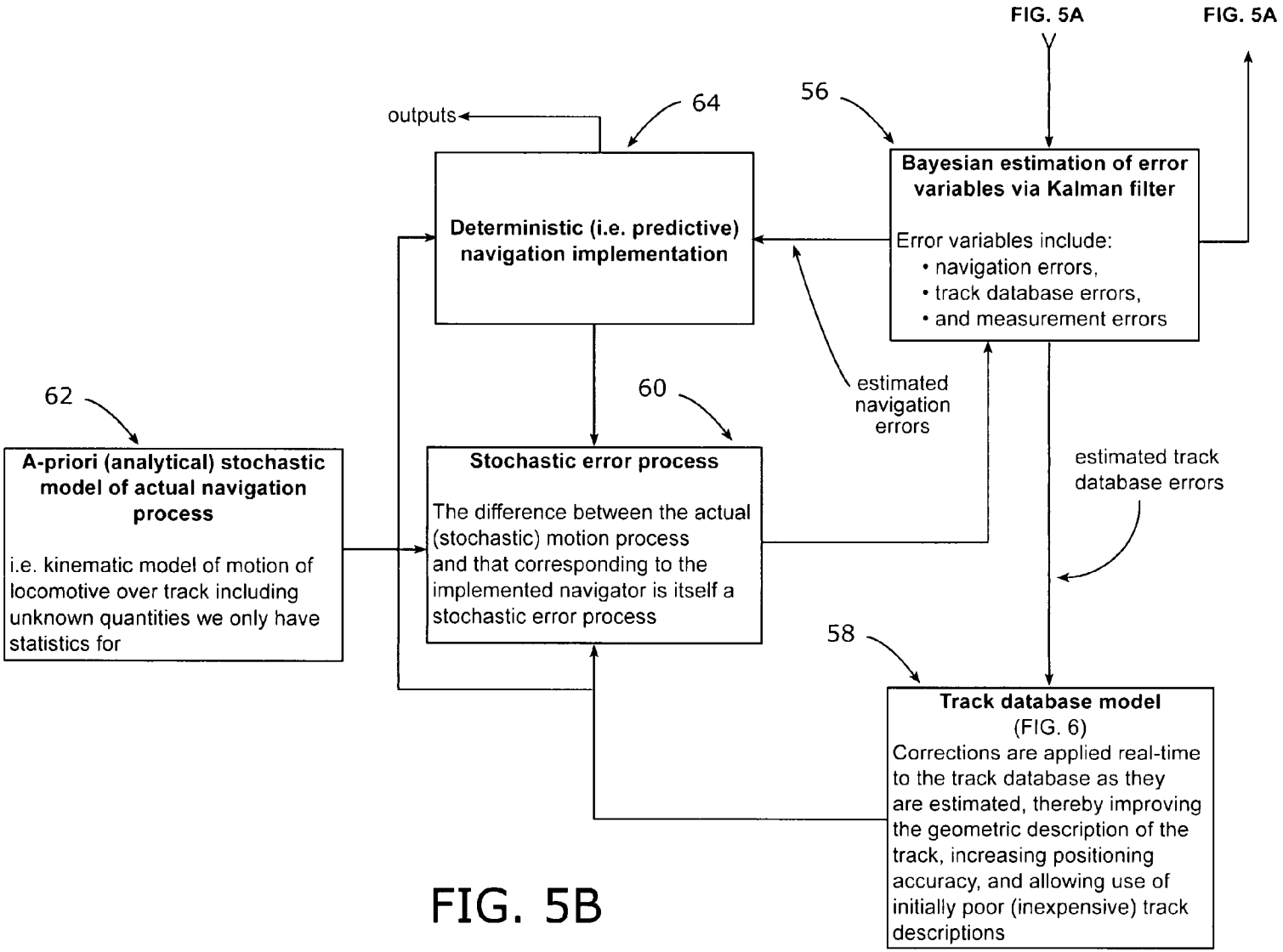
FIG. 5B is a second portion of schematic block diagram of the methodology of the present invention.

FIGS. 5A and 5B represent a schematic process diagram of the methodology of the present invention. As shown in FIG. 5A, information inputs and "estimated measurement errors" are provided to a process operation 50 that implements the measurement-aiding sensors and signals which, in turn, output to the stochastic measurement aiding operation 52. As shown in FIG. 5A, the stochastic measurement aiding operation 52 accepts, as an input, the output of the a-priori (analytical) stochastic model of the measurement-aiding operation 54. The stochastic measurement aiding operation 54 provides its output to a Kalman filter 56 (FIG. 5B), or a functional equivalent thereof, that provides a Bayesian estimation of the error variables (including navigation errors, track database errors, and measurement errors).

A portion of the output of the Kalman filter 56 is fed back to the process operation 50 (FIG. 5A) with the output of the Kalman filter 56 provided to a track database model 58 (FIG. 5B). The output of the track database model 58 couples to the stochastic error process 60 which, in turn, feeds back into the Kalman filter 56; the stochastic error process 60 also accepts an input from an a-priori (analytical) stochastic model of actual navigation process 62 in a manner analogous to that of function block 54 in FIG. 5A. The deterministic (i.e. predictive) navigation operation 64 accepts as an input, the 'estimated navigation errors" from the track database model 58 and the Kalman filter 56 to provide the method outputs.

Figure 6:
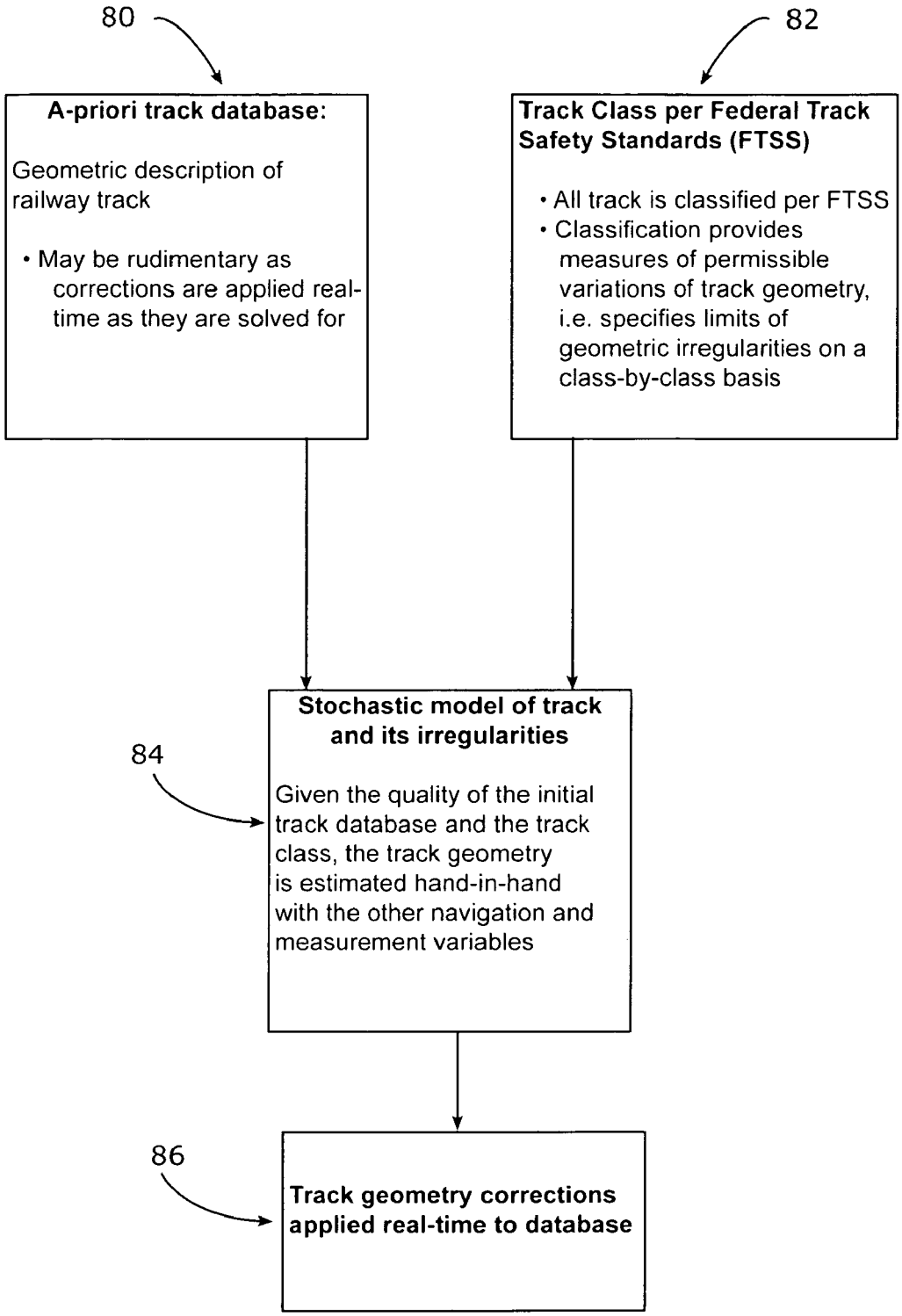
FIG. 6 is a model of the track database.

The track database model is shown in FIG. 6 and includes a stochastic model of track and its irregularities 84 established upon the a-priori track database 80 (i.e., a geometric description of the railway track) and the track class information 82; the stochastic model of track and its irregularities 84 provides its outputs at 86 to effect track geometry correction that are applied real-time to the track database.

A typical track geometry profile interpolation model is shown here. In words, $\psi(a)$, the track heading at along-track position "a," is given by the heading at along-track position A plus a portion of the difference in heading from position A to further along-track position B. The portion of the difference added is determined by a/L, where L is the length of track between points A and B, and a is the position offset from reference point A, i.e., a equals zero at point A and equals L at point B.

$$\psi(a)=\psi_A+(\psi_B-\psi_A)(a/L)=\psi_A+ca$$

As shown, this is equivalent to the heading at point A plus the offset a times the track curvature, c. This latter form is most useful for the compensation scheme herein.

In practice, the locomotive navigation function retrieves curvature from database lookup at its current position along the track, i.e. at position a. This retrieved curvature is denoted $c_{DB}$. However, the actual curvature at position a is given by $$c=c_{DB}(f(a))+c_{\Delta}$$

This equation models the facts that: (i.) position a per the database is not the same as position a per the physical track layout so the lookup procedure processes a perturbed value of along-track position given by f(a) (consider the fact that traversing left-to-right in FIGS. 2 and 3 the curvilinear length of the physical track is longer versus the straight or tangent track as modeled by the database), and (ii.) the database contains parametric error in its stored value of curvature.

The unknown parametric error can be estimated as part of the navigation function by representing its time differential as a function of input noise parameter whose level is adjusted per track class. For example, the curvature error can be captured as the product of rate of change of curvature multiplied by velocity, wherein the rate of change of curvature κ is modeled as a random walk process whose time derivative is merely a stationary white noise process w, the variance of which is adjusted in accord with the designated track class, i.e.

$$\dot{c}_{\Delta}=\kappa v$$

$$\dot{\kappa}=W$$

In this manner the track curvature correction is able to be estimated as part of the overall navigation and estimation (Kalman) filter scheme.

The redundant route determination calculation based on self-differential GPS is explained here. The basic carrier range measurement (CR) available from the GPS receiver for satellite j is given by $$CR_j=R'_j-e_j+(cb)-(cb)_j-R\text{iono}_j+R\text{tropo}_j+R\text{relativ}_j+n_j+\upsilon_j$$

The variables involved in this equation are:

$R'_j-e_j$ the actual geometric range from the receiver to satellite j, given as the range computed via ephemeris data minus the error along the line of sight due to errors inherent to the ephemeris data (cb) range error due to receiver clock bias $(cb)_j$ range error due to satellite clock bias $R\text{iono}_j$ range error due to delay of signal while propagating through ionosphere between satellite j and the receiver $R\text{tropo}_j$ range error due to advance of signal while transiting through the troposphere between satellite j and the receiver $R\text{relativ}_j$ relativistic range error $n_j$ carrier phase cycle count integer ambiguity $\upsilon_j$ small random processing error The carrier range equation applies at any measurement epoch. The epoch designation is omitted for clarity above. A double-difference equation is formed to address the route determination problem. The measurement epoch prior to traversing a point of divergence, i.e. a track switch, is selected as a reference epoch corresponding to reference measurement time $t^0$. The spatial position of the receiver at this time is held as a reference value, as are the carrier range measurements to available satellites.

On a satellite-by-satellite basis the "first difference" is formed as carrier range measurements at subsequent epochs minus their measurements at the reference epoch. Next, the second difference is formed as the difference of "first differences" between satellites and one selected reference satellite, denoted by k. For no loss of carrier phase lock to any of the available satellites during the switch traversal, and considering atmospheric, ephemeris, and relativistic errors nominally constant over the one second or less epoch intervals, the double-differencing operation results in a set of equations for the change of geometric range between the receiver and each satellite from the selected reference point and reference satellite, prior to the track switch. Using the subscript j to denote various satellites and subscript k to denote a selected reference satellite this is given as $$[CR(t)-CR(t^0)]_j-[CR(t)-CR(t^0)]_k=[R(t)-R(t^0)]_j-[R(t)-R(t^0)]_k+v_{jk}$$

Variable t indicates epoch times subsequent to the reference time $t^0$ and $v_{jk}$ is a residual random noise term, whitened by its composite or collective nature. If a minimum of four satellites are in view throughout the turnout traversal, the above equation is solved for the spatial change of position from the reference position prior to the turnout with high accuracy. Though only three unknown spatial coordinates are to be determined, four satellites are required by virtue of the need for one to be used as a reference satellite k.

For example, with four satellites visible at each epoch during turnout traversal the change in each of the three spatial coordinates Δx, Δy, and Δz from the selected reference coordinates are solved from the three double-difference equations for j=satellite 1, satellite 2, satellite 3, and k=reference satellite 4. The route determination problem is subsequently solved by comparison of the turnout geometry and the solved relative movement through the turnout.

The present invention advantageously estimates and corrects errors in the track database in real time and functions to provide some relief of initial track database requirements and/or allow for perturbations over time. Additionally, fewer database parameters are required, since the need for grade or superelevation will be diminished or eliminated and track points will be less dense. The GPS solution is computed that is constrained to the compensated track profile thereby allowing valid position solutions to be computed from line-of-sight to as few as one satellite. In addition, safety is enhanced by sensor redundancy and, when the carrier phase GPS processing is accomplished, redundancy for turnout calculations is available.

As will be apparent to those skilled in the art, various changes and modifications may be made to the illustrated embodiment of the present invention without departing from the spirit and scope of the invention as determined in the appended claims and their legal equivalent.

The invention claimed is:

1. A method for navigation in a system including railway track having a plurality of track irregularity classes with a quantitative value associated with each class and a railway vehicle for movement along the railway track having a navigation system for determining railway vehicle position along the railway track, the navigation system including a database having at least a geometric track model contained therein, the navigation system also including inertial components for measuring heading and variations thereof and acceleration and variations thereof and a satellite responsive GPS for providing geopositional data, comprising the steps of:

establishing an a-priori stochastic model of actual navigation errors and an a-priori stochastic model of a measurement aiding process;

effecting a Kalman type filtering of error variables to create estimated track database errors constrained by the track irregularity class; and implementing substantially real-time feedback of estimated track database errors for correcting the geometric track model contained in the database for subsequent use for navigation upon the railway track.

2. The method of claim 1, wherein said second-mentioned step includes providing, as an input thereto, a satellite-based GPS measurement related to a current position of the railway vehicle on the railway track.

3. A method for rail track database compensation in a system including railway track having a plurality of track irregularity classes with a quantitative value associated with each class and a railway vehicle for movement along the railway track having a navigation system for determining railway vehicle position along the railway track, the navigation system including a database having at least a geometric track model contained therein, the navigation system also including inertial components for measuring heading and variations thereof and acceleration and variations thereof and a satellite responsive GPS for providing geo-positional data, comprising the steps of:

establishing an a-priori stochastic model of actual navigation errors and an a-priori stochastic model of a measurement aiding process;

effecting a Kalman type filtering of error variables to create estimated track database errors constrained by the track irregularity class; and implementing substantially real-time feedback of estimated track database errors for correcting the geometric track model contained in the database for subsequent use for navigation upon the railway track.

4. The method of claim 3, wherein said second-mentioned step includes providing, as an input thereto, a satellite-based GPS measurement related to a current position of the railway vehicle on the railway track.

5. A method of simultaneous navigation and rail track database correction in a system including railway track having a plurality of track irregularity classes with a quantitative value associated with each class and a railway vehicle for movement along the railway track having a navigation system for determining railway vehicle position along the railway track, the navigation system including a rail track database having at least a geometric track model contained therein, the navigation system also including inertial components for measuring heading and variations thereof and acceleration and variations thereof and a satellite responsive GPS for providing geo-positional data, comprising the steps of:

establishing an a-priori stochastic model of actual navigation errors and an a-priori stochastic model of a measurement aiding process;

effecting a Kalman type filtering of error variables to create estimated track database errors constrained by the track irregularity class; and implementing substantially real-time feedback of estimated track database errors previously presented for navigation upon the railway track.

6. The method of claim 5, wherein said second-mentioned step includes providing, as an input thereto, a satellite-based GPS measurement related to a current position of the railway vehicle on the railway track.

* * * * *